United States Patent [19]

Sudjian

[11] 4,377,007

[45] Mar. 22, 1983

[54] CONVERTIBLE LENGTH GARMENT

[75] Inventor: Mary Sudjian, Elkins Park, Pa.

[73] Assignee: Nannette Manufacturing Company, Inc., Philadelphia, Pa.

[21] Appl. No.: 291,464

[22] Filed: Aug. 10, 1981

[51] Int. Cl.[3] ..... A41D 1/22; A41D 17/02

[52] U.S. Cl. ..... 2/105; 2/74; 2/243 R

[58] Field of Search ..... 2/105, 74, 243, 69, 2/106

[56] References Cited

U.S. PATENT DOCUMENTS

| | | | |
|---|---|---|---|
| 800,447 | 9/1905 | Jeanson . | |
| 996,210 | 6/1911 | Carroll . | |
| 1,196,747 | 8/1916 | Malzen . | |
| 1,283,643 | 11/1918 | Borgenicht . | |
| 1,549,516 | 8/1925 | Smith . | |
| 2,303,536 | 12/1942 | Friedman . | |
| 2,717,395 | 9/1955 | Holshouser . | |
| 2,766,454 | 10/1956 | Rice . | |
| 2,942,271 | 6/1960 | Frankenfield | 2/74 |
| 3,064,265 | 11/1962 | Bridgewaters . | |
| 3,820,165 | 6/1974 | Negherbon . | |
| 3,877,079 | 4/1975 | O'Brant | 2/243 |

OTHER PUBLICATIONS

Leaf-Chronicle, 5-31-71, Clarksville, Tenn. Publication.

*Primary Examiner*—Doris L. Troutman
*Attorney, Agent, or Firm*—Robert C. Podwil

[57] ABSTRACT

A long dress is made up of a slip-like underdress which may be worn under a short overdress or alone, the overdress and the underdress, when worn together, providing the appearance of a long dress. The overdress and the underdress may be worn alone, however, if desired.

9 Claims, 3 Drawing Figures

FIG. 2
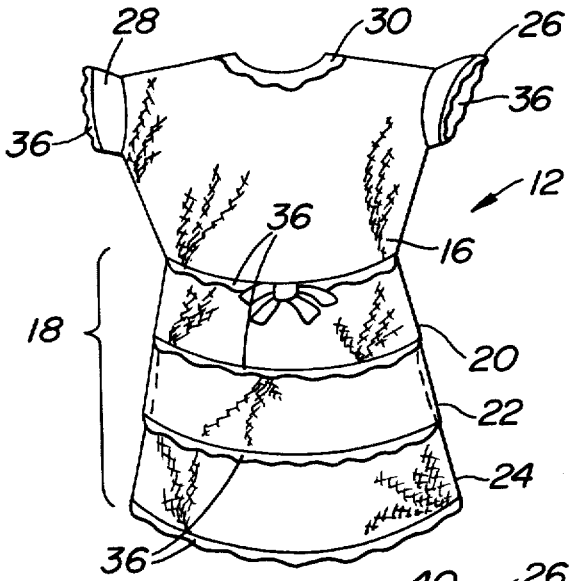
FIG. 3
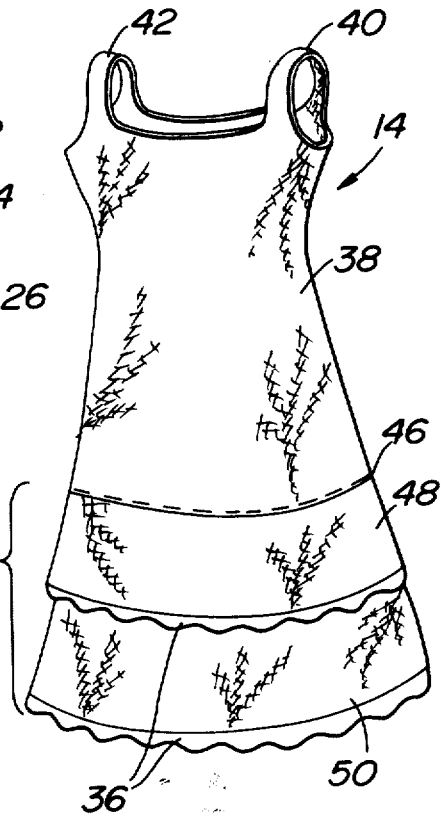
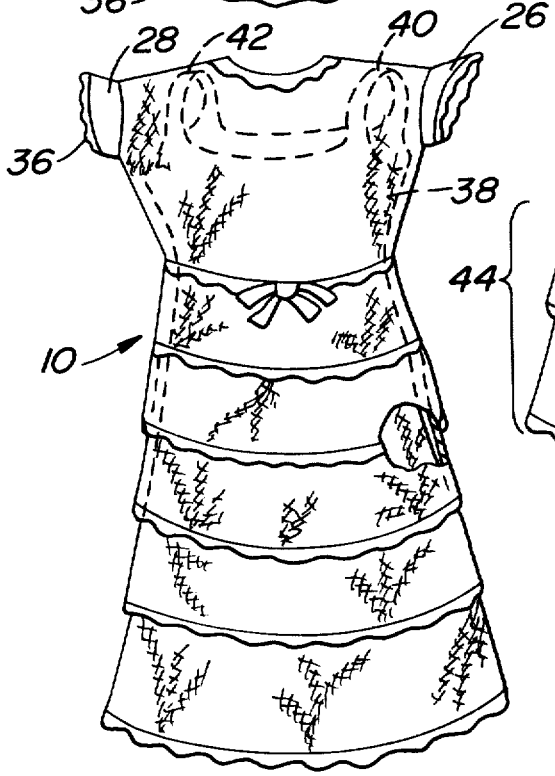
FIG. 1

CONVERTIBLE LENGTH GARMENT

BACKGROUND OF THE INVENTION

This invention relates to a convertible length garment, and more particularly, to a dress for girls or women which is capable of use as a short or long garment. More particularly, this invention relates to a convertible length dress or the like, made in two components, wherein the wearing of the two components together gives the appearance of a long dress or gown, although one of the components may be worn alone as a short dress and the other may be worn alone as a slip.

Garments which are convertible as to length or style have heretofore been proposed. For example, in U.S. Pat. No. 800,447, issued Sept. 26, 1905, to B. W. Jeanson, a ladies' undergarment was disclosed, comprising two parts, detachably connected, one of the parts being an ordinary pair of trunks or drawers and the other comprising loosely flowing skirt members detachably connected (by buttons) to the legs of the trunks or drawers at or near the knees. T' e effect of this arrangement, when worn beneath a conventional overskirt, was the appearance of a petticoat.

In U.S. Pat. No. 3,064,265, issued Nov. 20, 1962, to V. M. Bridgewaters, an adjustable and reversible garment was disclosed, in which the skirt of a dress as well as the bodice could be modified by applying to the basic garment buttoned-on upper and lower sections.

Add-on skirt sections, fastened by snaps or Velcro hook-eye fasteners, were disclosed in a publication dated May 31, 1971, in the Clarksville, Tenn., Leaf-Chronicle.

It is an object of the present invention to provide a convenient and economical two-piece garment, components of which may be used as a short dress or a slip, and which, when worn together give the appearance of a conventional longer dress or gown.

It is another object of this invention to provide a garment which, without the use of buttons or other fasteners, makes possible convertibility from one desired appearance to another, in each condition of the garment providing a finished and attractive appearance.

Other objects will appear hereinafter.

SUMMARY OF THE INVENTION

The foregoing objects are realized, in a presently preferred form of the invention (which represents the best mode contemplated for carrying the invention into effect) by a convertible length garment comprising an overdress capable of being worn alone and having a first skirt portion, and a complimental underdress adapted to be worn beneath the overdress. In the preferred form of the invention, the underdress has a second skirt portion which, when the underdress is worn, extends beyond the hemline of the first skirt portion and provides an extension or continuation of the silhouette begun by the first skirt portion. In other words, the skirt portion of the underdress provides an extension of the first skirt portion, which, in association with the first skirt portion, extends the length of the garment. Thus, the overdress may itself provide a conventional short dress. The overdress in association with the underdress, however, may provide, in effect, a long garment such as a gown. The underdress may be worn alone as a slip.

The decorative motif of the first skirt portion may advantageously by continued in the skirt portion provided by the underdress, although it will be recognized that complimental rather than identical designs may be provided by the two skirt portions.

For the purpose of illustrating the invention, there is shown in the drawings a form of the invention, it being understood, however, that the invention is not limited to the precise arrangements and instrumentalities shown.

DESCRIPTION OF THE DRAWINGS

FIG. 1 is a perspective view of a convertible length garment in accordance with the present invention;

FIG. 2 is a perspective view of an overdress which is a part of a garment in accordance with the invention; and FIG. 3 is a perspective view of an underdress which is a part of a garment in accordance with the invention.

DESCRIPTION OF PREFERRED EMBODIMENT

Referring now to the drawings in detail, wherein like reference numerals indicate like elements, there is seen in FIG. 1 a convertible length garment designated generally by the reference numeral 10. The garment 10 is made in two components, namely an overdress designated generally by the reference numeral 12 and an underdress designated generally by the reference numeral 14. The overdress 12 is shown in FIG. 2, and the underdress 14 in FIG. 3.

Referring now to FIG. 2, the overdress 12, it will be seen, has the appearance of a fully conventional girl's dress, and comprises a bodice 16, joined at the waist to a skirt portion 18. The skirt portion 18, in the illustrated embodiment, is provided with a series of decorative ruffles 20, 22 and 24. The illustrated overdress 12 includes sleeves 26 and 28 affixed to the bodice 16. The neckband 30, sleeves 26, 28, waist 32, hem 34 and the ruffles 20 and 22 may be decorated in a conventional manner with lace 36 as illustrated, or by other well-known means such as ribbon, piping or the like.

Referring now to FIG. 3, the underdress 14 comprises a bodice 38 having shoulder straps 40 and 42. The bodice 38 is joined to a skirt portion 44, the length of which exceeds the length of the skirt portion 18 of the overdress 12.

Joined to the bodice 38 by stitching 46 or the like is a skirt portion 44, provided in the illustrated embodiment with decorative ruffles 48 and 50. The ruffles 48 and 50 are complimental in appearance with the above-mentioned ruffles 20, 22 and 24 of the overdress 12, and may be decorated with lace 36 in the same manner.

Referring once again to FIG. 1, the manner in which the overdress 12 and underdress 14 combine to provide the appearance of a long dress should now be apparent. From FIG. 1, it should be evident that in using the convertible length garment 10, the wearer (not shown) would first put on over underclothing the underdress 14, and then the overdress 12. The effect of the decoration of the underdress 14 and the ruffles 20, 22, 24, 48 and 50 in the illustrated form of the invention, is to provide the appearance of a continuous, uniformly decorated long skirt.

It should also be apparent that the overdress 12 and underdress 14 have individual utility. The overdress 12 appears conventional in every respect, and thus, may be worn separately as a short dress if so desired. Similarly, the underdress 14 may be worn as a slip.

The present invention may be embodied in other specific forms without departing from its spirit or essential attributes, and accordingly, reference should be made to the appended claims rather than the foregoing specification as indicating the scope of the invention.

I claim:

1. A convertible length garment comprising an overdress capable of being worn alone and having a first skirt portion, and a complimental underdress adapted to be worn beneath the overdress, said underdress having a second skirt portion extending, when said overdress and underdress are worn together, beyond the hemline of said first skirt portion, whereby said second skirt portion provides an extension of said first skirt portion.

2. A convertible length garment in accordance with claim 1, wherein said first and second skirt portions have complimental ornamentation thereon, so that said first and second skirt portions together provide the appearance of a single long skirt when said overdress and underdress are worn together.

3. A convertible length garment in accordance with claim 2, wherein said ornamentation comprises a series of ruffles.

4. A convertible length garment in accordance with claim 1, wherein said first skirt portion is provided with a series of ruffles, and said second skirt portion having at least one ruffle complimental in its appearance to said ruffles of said first skirt portion, whereby said first and second skirt portions together provide the appearance of a single long ruffled skirt.

5. A convertible length garment in accordance with claim 1, wherein said underdress is capable of being worn alone as a slip.

6. A convertible length garment in accordance with claim 1, wherein said underdress comprises a plain bodice and shoulder straps, said second skirt portion being affixed to said bodice so that said second skirt portion extends, when said overdress and underdress are worn together, beyond the hemline of said first skirt portion.

7. A convertible length garment in accordance with claim 6, wherein said overdress comprises a bodice and sleeves, said first skirt portion extending from said bodice.

8. A convertible length garment comprising an overdress capable of being worn alone and having a first skirt portion, and a complimental underdress adapted to be worn beneath the overdress or alone, said underdress having a second skirt portion extending, when said overdress and underdress are worn together, beyond the hemline of said first skirt portion, whereby said second skirt portion provides an extension of said first skirt portion, said first skirt portion having a series of ruffles, and said second skirt portion having at least one ruffle complimental in its appearance to said ruffles of said first skirt portion, said underdress comprising a plain bodice and shoulder straps, said second skirt portion being affixed to said bodice so that said second skirt portion extends, when said overdress and underdress are worn together, beyond the hemline of said first skirt portion.

9. A convertible length garment in accordance with claim 8, wherein said overdress comprises a bodice and sleeves, said first skirt portion extending from said bodice.

* * * * *